US011273548B2

(12) United States Patent
Chernik

(10) Patent No.: US 11,273,548 B2
(45) Date of Patent: Mar. 15, 2022

(54) TORQUE-ASSIST

(71) Applicant: New Revo Brand Group, LLC

(72) Inventor: Ryan Chernik, New Brighton, MN (US)

(73) Assignee: New Revo Brand Group, LLC, Plymouth, MN (US)

( * ) Notice: Subject to any disclaimer, the term of this patent is extended or adjusted under 35 U.S.C. 154(b) by 455 days.

(21) Appl. No.: 16/239,230

(22) Filed: Jan. 3, 2019

(65) Prior Publication Data

US 2019/0366529 A1 Dec. 5, 2019

Related U.S. Application Data

(60) Provisional application No. 62/680,377, filed on Jun. 4, 2018.

(51) Int. Cl.

| | |
|---|---|
| ***B25G 1/00*** | (2006.01) |
| ***B25G 1/10*** | (2006.01) |
| ***B25G 1/08*** | (2006.01) |
| ***B25B 23/18*** | (2006.01) |
| ***B25B 23/142*** | (2006.01) |

(52) U.S. Cl.

CPC ..... *B25G 1/005* (2013.01); *B25B 23/1427* (2013.01); *B25B 23/18* (2013.01); *B25G 1/085* (2013.01); *B25G 1/102* (2013.01)

(58) Field of Classification Search

None

See application file for complete search history.

(56) References Cited

U.S. PATENT DOCUMENTS

| | | | | |
|---|---|---|---|---|
| 2,870,809 A | | 1/1959 | Feldman et al. | |
| 3,561,510 A | * | 2/1971 | Johnson | B25G 1/005 81/436 |
| 3,656,523 A | | 4/1972 | McGee | |
| 3,863,693 A | | 2/1975 | Carriker | |

(Continued)

FOREIGN PATENT DOCUMENTS

GB 2462279 A 3/2010

OTHER PUBLICATIONS

Allyiqi, Aqsh Digital Torque Driver, Website, 1, United States of America. https://www.alibaba.com/product-detail/AQSH-Digital-Torque-Driver_60797875094.html.

*Primary Examiner* — Brian D Keller

(74) *Attorney, Agent, or Firm* — Grumbles Law PLLC; Brittany Nanzig

(57) ABSTRACT

A screwdriver system can include a primary driver and a secondary driver. The primary driver can include an attachment feature configured to couple to a driver bit socket. The attachment feature can be mechanically coupled to the driver shaft such that torque applied to the attachment feature is transferred to the shaft. The secondary driver can include a driver bit socket at the end of its shaft. The attachment feature of the primary driver can be structured, configured, and oriented such that the secondary driver can reversibly couple to the attachment feature via the driver bit socket of the secondary driver shaft. The secondary driver, when so-coupled, can be oriented with the primary axis of the secondary driver shaft generally perpendicular to the primary axis of the primary driver. In some examples, the primary driver can be a torque wrench.

19 Claims, 6 Drawing Sheets

(56) References Cited

U.S. PATENT DOCUMENTS

| | | | | |
|---|---|---|---|---|
| 4,000,767 | A | 1/1977 | Geng | |
| 4,542,667 | A | 9/1985 | Jang | |
| 4,768,137 | A * | 8/1988 | Hwaw | B25B 23/18 362/120 |
| 5,265,504 | A * | 11/1993 | Fruhm | B25G 1/085 81/177.4 |
| 5,526,724 | A * | 6/1996 | Bruggeman | B25G 1/046 81/177.4 |
| 5,749,272 | A | 5/1998 | Phan | |
| 6,085,620 | A | 7/2000 | Anderson et al. | |
| 6,237,451 | B1 * | 5/2001 | Wei | B25G 1/085 81/177.4 |
| 6,286,395 | B1 * | 9/2001 | Frazier | B25B 13/005 81/124.7 |
| 6,378,402 | B1 | 4/2002 | Kalomeris et al. | |
| 6,490,954 | B2 | 12/2002 | Johnson et al. | |
| 6,595,300 | B2 | 7/2003 | Milbourne | |
| 7,069,823 | B1 | 7/2006 | Howell | |
| 7,228,766 | B1 | 6/2007 | Shyu | |
| 7,344,118 | B2 | 3/2008 | Samberg | |
| 2004/0206215 | A1 | 10/2004 | Athanasiou et al. | |
| 2008/0127783 | A1 | 6/2008 | Wadsworth | |
| 2009/0272238 | A1 | 11/2009 | Harris | |
| 2012/0103146 | A1 | 5/2012 | Hernandez | |
| 2019/0314962 | A1 * | 10/2019 | King | B25B 23/1425 |

* cited by examiner

TORQUE-ASSIST

FIELD OF THE INVENTION

This disclosure relates to hand tools, and more particularly, relates to hand tools configured to aid a user in applying torque.

BACKGROUND OF THE INVENTION

Bit drivers are among the most fundamental of hand tools, with great utility in applying torque to devices such as screws via driver bits. Occasionally a need arises to apply a greater torque via a bit driver than is possible for a typical user to achieve without difficulty. It would be desirable to provide improved hand tools that enable users to effectively, safely, and more easily apply greater torques to target devices.

SUMMARY OF THE INVENTION

This disclosure relates to hand tools, and more particularly, relates to hand tools configured to aid a user in applying torque. In an illustrative but non-limiting example, the disclosure provides a screwdriver system that can include a primary driver and a secondary driver. The primary driver can include a shaft having a first end, a second end, and a primary axis. The shaft of the primary driver can include at the first end a hexagonal driver bit socket. The primary driver also can include a handle coupled to the shaft at the second end of the shaft. Said handle can be structured and configured generally parallel to the shaft such that it is ergonomically graspable by a user's hand with the user's hand generally wrapped around the primary axis of the shaft. The primary driver also can include a hexagonal attachment feature configured to couple to another hexagonal driver bit socket. The hexagonal attachment feature can be mechanically coupled to the shaft such that torque applied to the hexagonal attachment feature is transferred to the shaft. The primary driver can also include a swivel feature coupled to the handle structured and configured to receive manual force applied along the primary axis of the shaft. The secondary driver can include a secondary driver shaft having a first end, a second end, and a primary axis. The secondary driver shaft can include at the first end a hexagonal driver bit socket. The secondary driver also can include a secondary driver handle coupled to the secondary driver shaft at the second end of the secondary driver shaft. The secondary driver handle can be structured and configured generally parallel to the secondary driver shaft such that it is ergonomically graspable by a user's hand with the user's hand generally wrapped around the primary axis of the secondary driver shaft. The hexagonal attachment feature of the primary driver can be structured, configured, and oriented such that the secondary driver can reversibly couple to the hexagonal attachment feature via the hexagonal driver bit socket of the secondary driver shaft. The secondary driver, when so-coupled, can be oriented with the primary axis of the secondary driver shaft generally perpendicular to the primary axis of the shaft of the primary driver.

The above summary is not intended to describe each and every example or every implementation of the disclosure. The Description that follows more particularly exemplifies various illustrative embodiments.

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings, in which.

DETAILED DESCRIPTION

Figure 1:
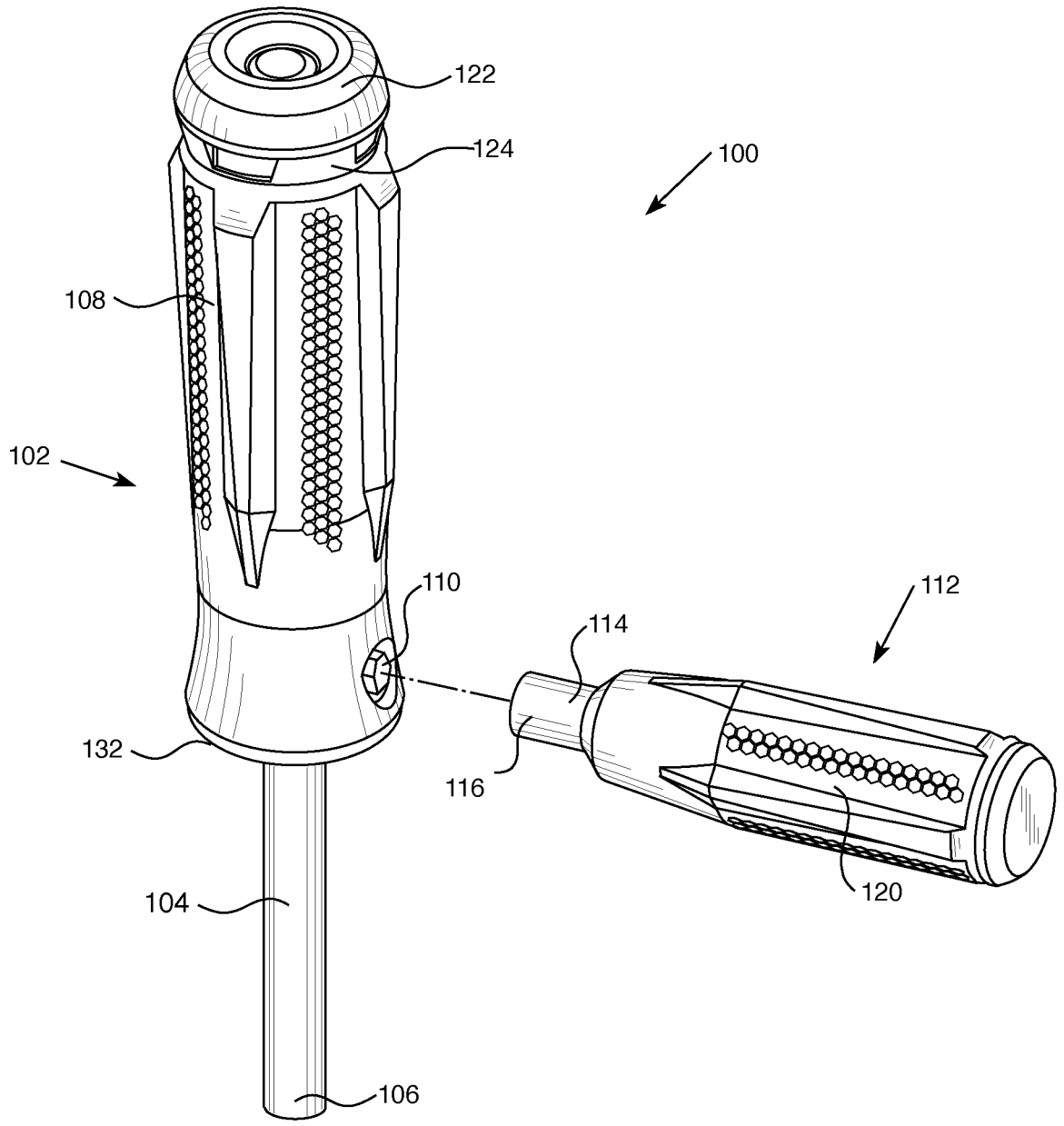
FIG. 1 is a schematic perspective view of an illustrative example of a torque-assist system of the present disclosure.

This disclosure relates to hand tools, and more particularly, relates to hand tools configured to aid a user in applying torque. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements, those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient, but these are intended to cover applications or embodiments without departing from the spirit or scope of the disclosure. Also, it is to be understood that the phraseology and terminology used herein are for the purpose of description and should not be regarded as limiting.

Bit drivers are among the most common and useful of hand tools. A typical conventional bit driver can include an elongate shaft with a bit socket at one end and a handle at the other end. The bit socket can receive interchangeable drive (or driver) bits, such as flat-blade, Philips, J.I.S., square, hex, Torx, etc., bits, depending on the target device (such as a screw) to which torque is to be applied. (In the present disclosure, including the claims, the term "screwdriver" can be used generically to refer to any driver, including a bit driver, unless in a particular instance it is made clear that the screwdriver is not configured to accept bits. Further, use of the term "screwdriver" should not be construed as limiting the scope of the disclosure and claims only to tools that drive screws. It is generally understood that screwdrivers can be used to apply torque to non-screw devices in a similar manner to how torque is applied to screws.) The handle commonly can be configured to receive a user's hand such that the hand is generally wrapped around the elongate shaft. In such a conventional bit driver design, friction between a user's hand and the handle can be replied-upon substantially both for transfer of torque to the tool from the hand, and for an axially-directed force (directed along the axis of the shaft) that can be desirable or needed to maintain contact between the tool and the target device. In some circumstances, the reliance upon friction can limit the torque and/or axial force that can be applied readily.

FIG. 1 is a schematic perspective view of an illustrative example of a torque-assist system 100 of the present disclosure. System 100 can include a primary or first driver 102, which can be a screwdriver and/or a bit driver, the primary driver having a shaft 104, a symmetry axis of the shaft lying along or defining a primary axis. First end 106 of shaft 104 can be structured and configured with a permanent drive implement such as a flat-blade, Philips-head, etc., or it can be structured and configured with a bit socket (such as, but not limited to, a ¼-inch bit socket) to receive an interchangeable drive bit. (A bit socket is not directly visible in FIG. 1, but its presence is implied due to the lack of an illustrated permanent driving implement.) Whether through a permanent drive implement or via a drive bit in a bit socket, shaft 104, at first end 106, can be regarded as being structured and configured to transfer torque to a target device.

Primary driver 102 can include a handle 108 that can be coupled to shaft 104 at a second end generally opposite first end 106. Handle 108 can be structured and configured generally parallel to shaft 104 such that it is ergonomically graspable by a user's hand with the user's hand generally wrapped around the primary axis of the shaft. Handle 108 can be generally cylindrical in shape, notwithstanding features such as ridges, etc., that may depart from the overall cylindrical shape and, for example, contribute to improved grip for a user. As described thus-far, primary driver 102 includes features that are shared with conventional bit drivers.

Figure 2:
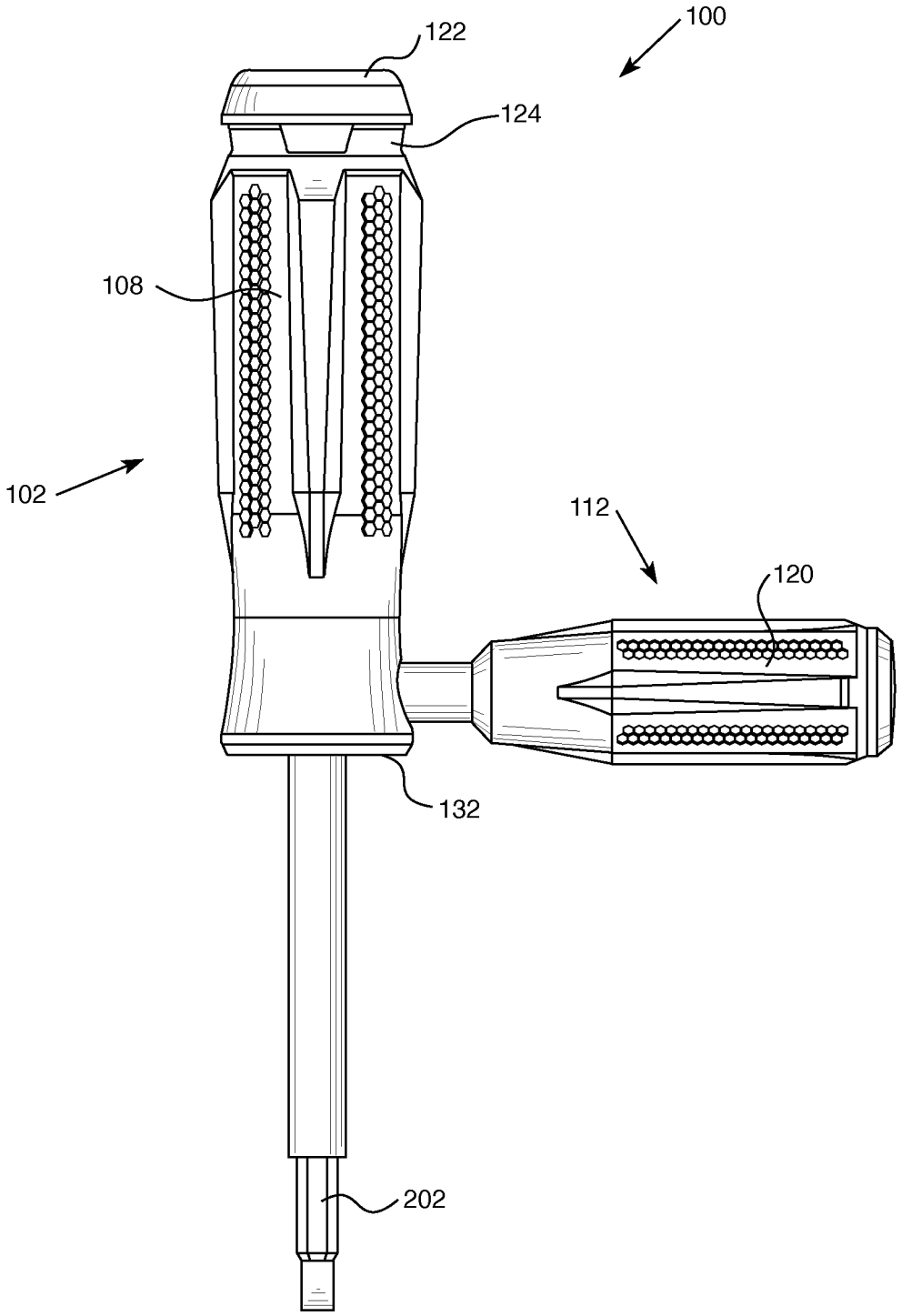
FIG. 2 is a schematic plan illustration of the secondary driver of the torque assist system of FIG. 1 coupled to the primary driver.

Primary driver 102 of torque-assist system 100 can inventively include further features that can assist a user in applying torque to a target device. Primary driver 102 can include an attachment feature 110 mechanically coupled to shaft 104 such that torque applied to the attachment feature is transferred to the shaft. Attachment feature 110 can be structured, configured, and oriented such that a secondary or second driver 112, described further herein, can reversibly couple to the attachment feature. Attachment feature 110 can be structured, configured, and oriented such that secondary driver 112, when so-coupled, is oriented with its own primary axis generally perpendicular to the primary axis of shaft 104 of primary driver 102, as illustrated in FIG. 2. In some examples of torque-assist system 100, attachment feature 110 can be a ¼-inch (or other size) hexagonal stud, but this is not limiting and other configurations are possible. When attachment feature 110 is a hexagonal stud, said stud can be similar to or structured essentially identically to the end of a drive bit that interfaces with a hexagonal bit socket of a bit driver.

Figure 3:
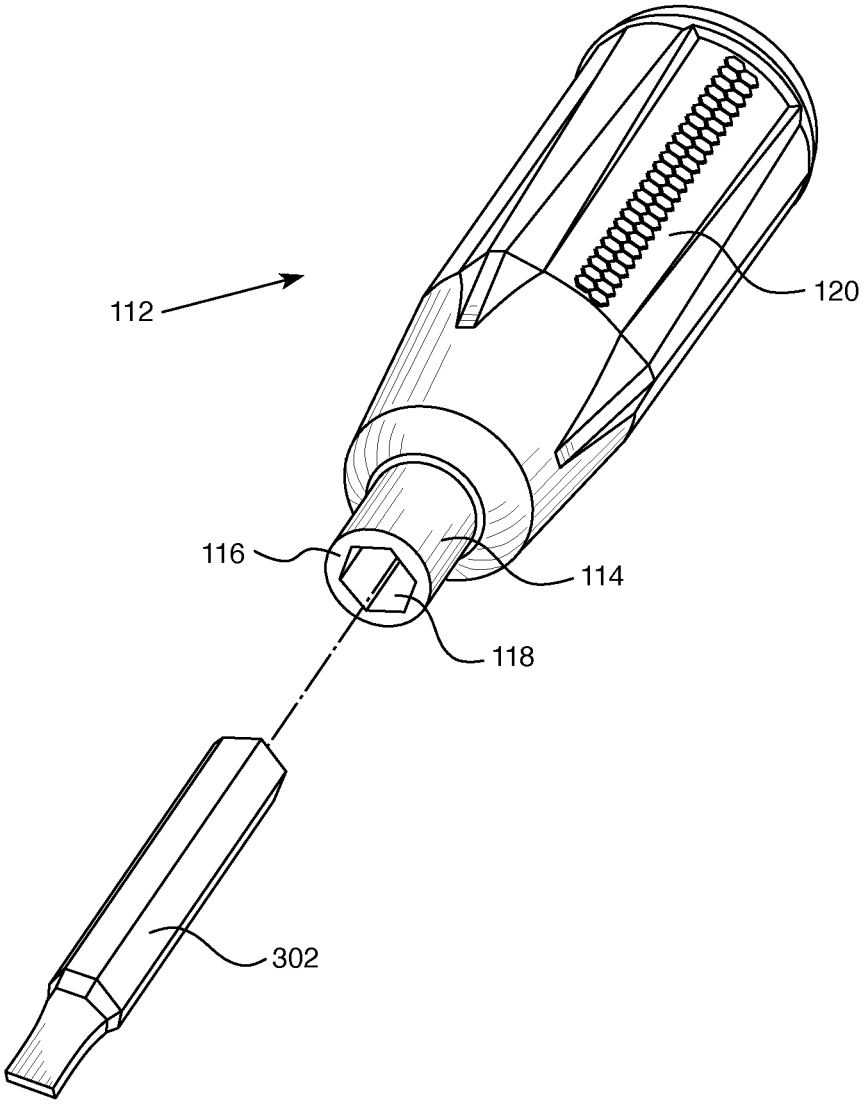
FIG. 3 is a schematic perspective view of the secondary driver and a drive bit.

Secondary driver 112 can be a screwdriver and/or a bit driver, and can include a secondary driver shaft 114 with a symmetry axis that lies along or defines a primary axis of the secondary driver shaft and secondary driver. Secondary driver shaft 114 can include at a first end 116 a bit socket 118 (such as, but not limited to, a ¼-inch bit socket) as best seen in FIG. 3, which is a schematic perspective view of secondary driver 112 and a bit 302 that can be received by bit socket 118. (First end 106 of shaft 104 of primary driver 102 can include a bit socket similarly as illustrated for first end 116 of secondary driver shaft 114 of secondary driver 112.) Secondary driver 112 can include a secondary driver handle 120 coupled to secondary driver shaft 114 at the second end of the secondary driver shaft. Secondary driver handle 120 can be structured and configured generally parallel to secondary driver shaft 114 such that it is ergonomically graspable by a user's hand with the user's hand generally wrapped around the primary axis of the secondary driver shaft, as illustrated in FIG. 5.

In operation, secondary driver 112 can be brought toward primary driver 102, for example (but not necessarily exclusively) along the dashed line of FIG. 1, then coupled to attachment feature 110. FIG. 2 is a schematic plan illustration of secondary driver 112 coupled to primary driver via attachment feature 110 (not visible in FIG. 2). When the attachment feature is a ¼ hexagonal stud and secondary driver 112 includes a ¼-inch bit socket, the coupling of the secondary driver to first driver 102 can include the ¼ hexagonal stud substantially occupying the bit socket (that is, the stud occupying nearly the entire interior volume of the socket), such that the primary and secondary drivers are mechanically coupled with little play therebetween. With secondary driver 112 so-coupled to primary driver 102, the secondary driver can significantly assist a user in applying torque to the primary driver, through which torque can be transferred to a bit 202 and ultimately delivered to a target device, such as a screw. A user's hand placed at secondary driver handle 120 can apply torque to primary driver 102 with a much larger lever arm than the alternative of a user's hand grasping handle 108 of the primary driver itself.

Figure 5:
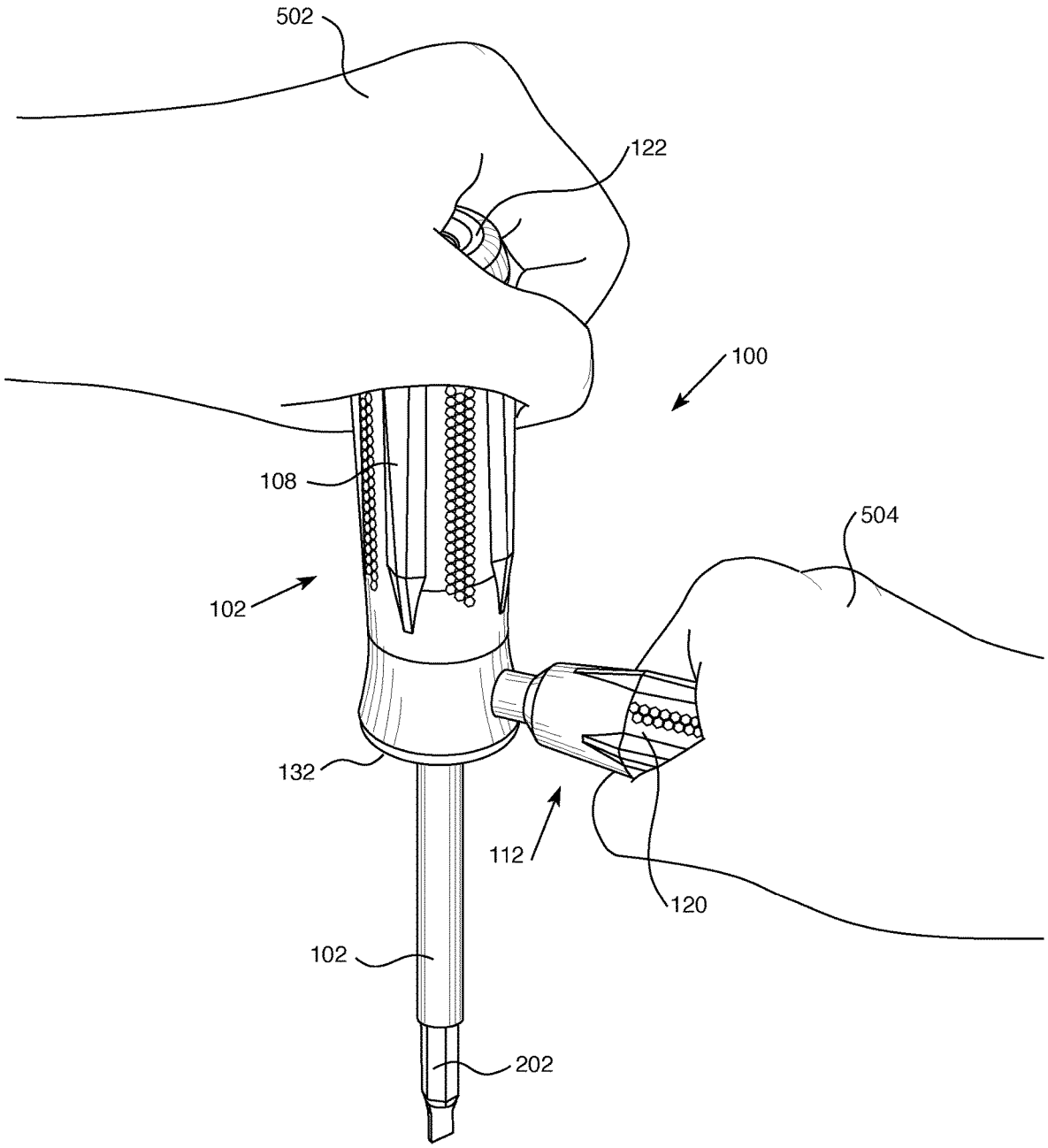
FIG. 5 is a schematic perspective illustration of a torque-assist system in a use scenario.

FIG. 5 is a schematic perspective illustration of a torque-assist system 100 in a use scenario. A user's first hand 502 is shown holding primary driver 102 at handle 108, with the user's second hand 504 (or possibly the hand of another user) holding secondary driver 112 at handle 120. First hand 502 can, among other things, be well-positioned to maintain the location of drive bit 202 at a target device to which torque is to be delivered. Second hand 504, with the benefit of its relatively large lever arm, can be well-positioned to transfer torque to system 100 and primary driver 102, by, for example, pulling toward or pushing away from the perspective of a viewer of FIG. 5. First hand 502 can also be well-positioned to apply force along the primary axis of shaft 104 of primary driver 102, for example, by pressing down (toward the bottom of the sheet of FIG. 5), which can assist in maintenance of contact between drive bit 202 and a target device to which it is coupled (not illustrated). Such a force can assist in application of torque to the target device by helping prevent the drive bit 202 from undesirably separating from the target device. Further, the location of attachment feature 110, and thus, the point at which secondary driver 112 couples to primary driver 102, can contribute to ease of use of torque assist system 100. Placement of attachment feature 110 relatively closer to first end 106 of shaft 104, as opposed to further away (that is, toward the end of handle 108 closer to the exposed portion of shaft 104 [as illustrated], as opposed to toward the butt end of the handle) can aid a user's ability to hold the system stably when applying torque to a target device. This is not limiting, however, and in the present disclosure, variations in positions of attachment feature 110 are contemplated (e.g., close to the butt end of handle 108, or close to first end 106 of shaft 104).

Primary driver 102 can further include one or more other features that can assist operation in relation to the manual application of force along the primary axis of shaft 104 of primary driver 102. Primary driver 102 can include a swivel feature 122 coupled to handle 108, but this is not necessary in all embodiments. Swivel feature 122 can be structured and configured to receive manual force applied along the primary axis of shaft 104, for example, pressure exerted by a palm or other part of a hand, as generally illustrated in FIG. 5. Swivel feature 122 can be further structured and configured to rotate about the primary axis of shaft 104 relative to handle 108, thereby facilitating rotation of the shaft relative to the swivel feature as manual force is applied to the swivel feature as the swivel feature is held essentially stationary. Swivel feature 122 can be located at the end of handle 108 opposite the first end 106 of shaft 104. Various small screwdrivers (e.g., "jeweler's" or "precision" screwdrivers) are known to include somewhat similar swivel features, with pressure generally applied by a fingertip, but inclusion of such a swivel feature in a large screwdriver (such as a screwdriver with a handle sized to readily accommodate grip by essentially an entire human hand) is believed to be a novel and inventive feature of the present disclosure.

Further possible features are contemplated for torque-assist systems of the present disclosure. Primary driver 102 can include a selectively-removable endcap 124 of handle 108, as perhaps best viewed in the exploded view of primary driver 102 provided by FIG. 4. Swivel feature 122 can be rotatably attached to selectively-removable endcap 124. Selectively-removable endcap 124 of handle 108 can provide access to, and security for, a storage compartment 126 of the handle. In some configurations, primary driver 102 can include an illumination system integrated with handle 108, and storage compartment 126 can house an illumination system power supply 128 such as a battery, battery-pack, etc. Selectively-removable endcap 124 of handle 108 can further include a switch 130 for the illumination system. The illumination system can include light sources located at the bit-facing surface or side 132 of handle 108. The light sources can be one or more light emitting diodes (LEDs). The LEDs can be discretely-packaged LEDs, surface-mount devices, chip-on-board (COB) LEDs, or any other suitable type.

Figure 4:
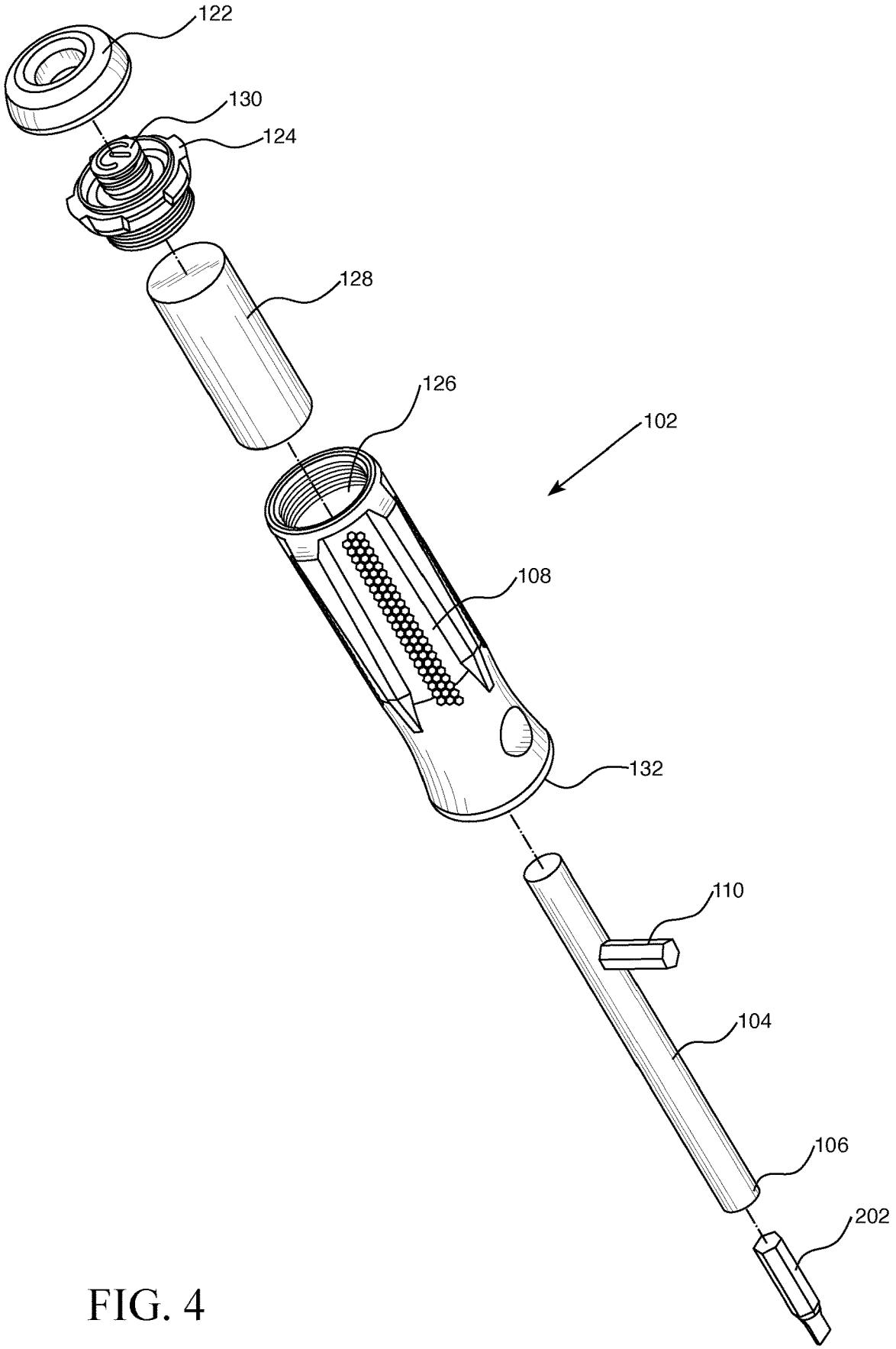
FIG. 4 is a perspective exploded view of the primary driver.

Note that in FIG. 4, attachment feature 110 is illustrated as being directly mechanically attached to shaft 104 of primary driver 102, but this is not limiting. In some embodiments, attachment feature 110 can be mechanically attached or coupled to shaft 104 indirectly. For example, in some embodiments attachment feature 110 can be directly mechanically attached to handle 108, and by merit of the handle's attachment to shaft 104, the attachment feature can be attached to shaft 104.

Figure 6:
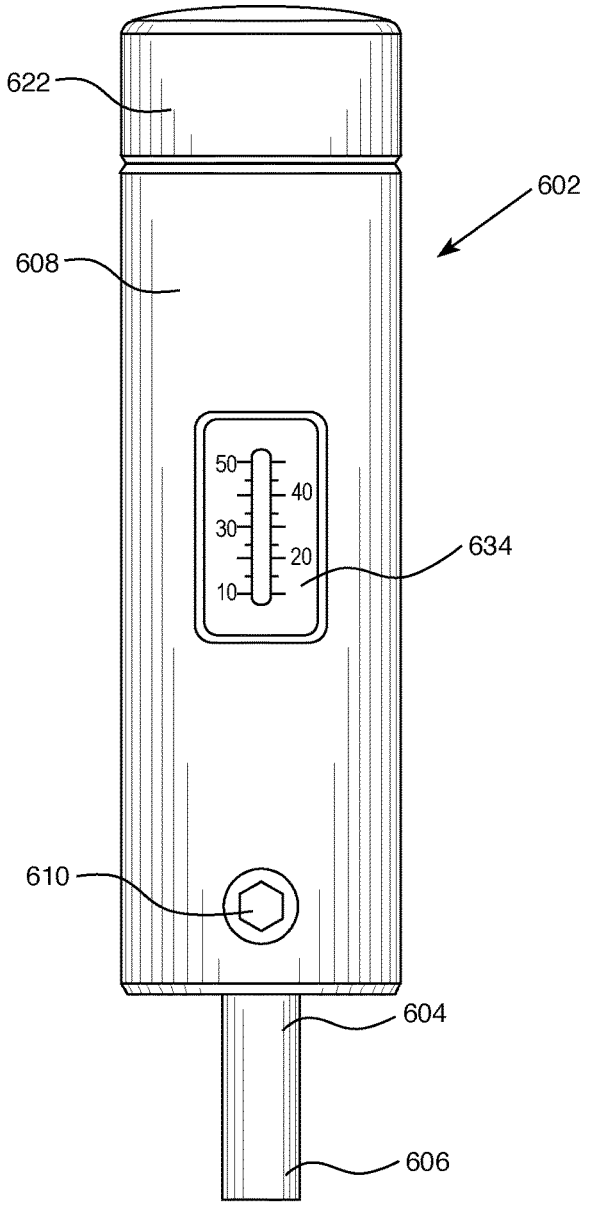
FIG. 6 is a schematic plan view of a primary driver that includes a torque measurement or limiting mechanism.
Figure 7:
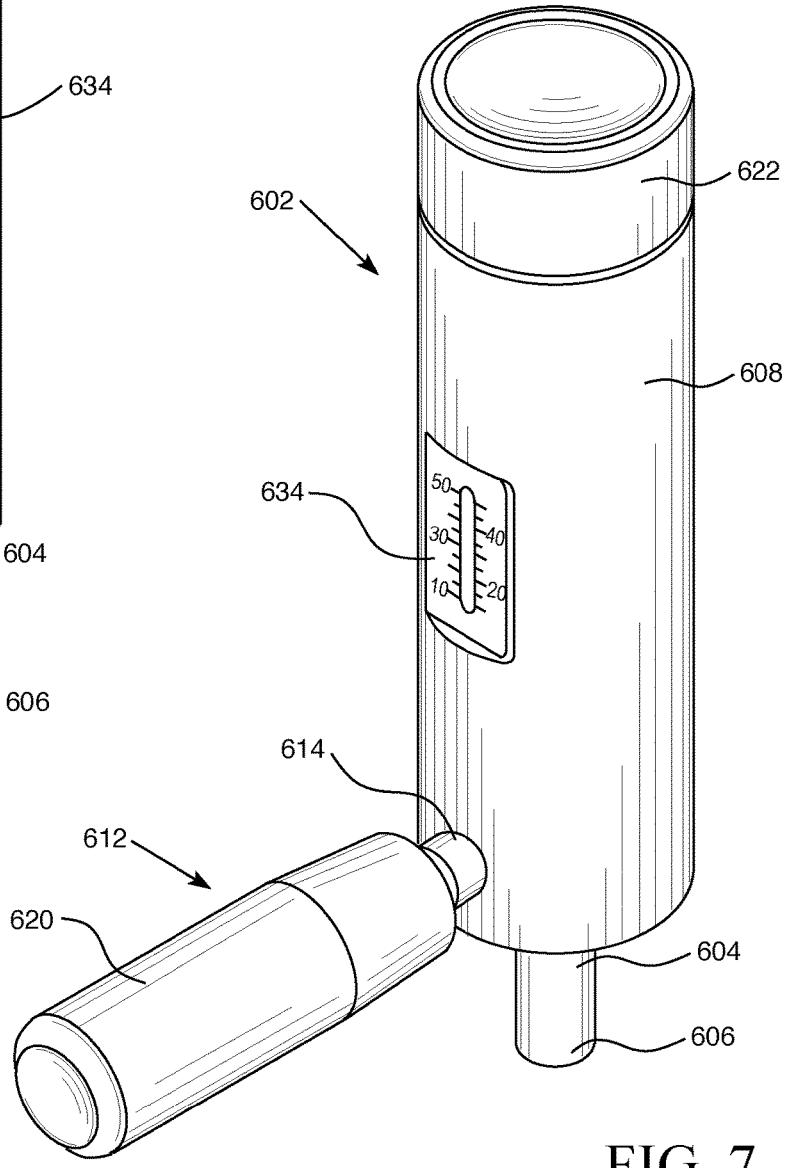
FIG. 7 is a schematic perspective view illustrating a secondary driver coupled to the primary driver of FIG. 6 such that the secondary driver can be used to impart torque to the primary driver.

FIGS. 6 and 7 illustrate features of another torque-assist system of the present disclosure. FIG. 6 is a schematic plan view of a primary driver 602 that includes a torque measurement or limiting mechanism. Primary driver 602 can include a shaft 604 that can include, at a first end 606, a bit socket or any other suitable structure configured to transfer torque to a target device. Primary driver 602 can include a handle 608 that can be coupled to shaft 604 at a second end generally opposite first end 606. Handle 608 can be structured and configured generally parallel to shaft 604 such that it is ergonomically graspable by a user's hand with the user's hand generally wrapped around the primary axis of the shaft. Handle 608 can be generally cylindrical in shape, but this is not limiting. Primary driver 602 can include an attachment feature 610 mechanically coupled to shaft 604 such that torque applied to the attachment feature is transferred to the shaft. Primary driver 602 can include a swivel feature 622 coupled to handle 108, but this is not necessary in all embodiments. Similarly as described elsewhere herein with regard to torque-assist system 100, the torque-assist system of FIGS. 6 and 7 can include a secondary driver 612 that can reversibly couple to attachment feature 610. Secondary driver 612 can include a handle 620 and a secondary driver shaft 614. Attachment feature 610 can be structured, configured, and oriented such that secondary driver 612, when coupled, is oriented with its own primary axis (along secondary driver shaft 614) generally perpendicular to the primary axis of shaft 604 of primary driver 602. FIG. 7 is a schematic perspective view illustrating secondary driver 612 coupled to primary driver 602 via attachment feature 610 (not visible in FIG. 7) such that the secondary driver can be used to manually impart torque to the primary driver. As described thus far, the torque-assist system of FIGS. 6 and 7 can include features that can be substantially similar to those of system 100 described elsewhere herein, and it generally can exhibit variations as described for system 100.

In some embodiments, primary driver 602 can be a torque wrench that further incorporates a torque measurement and/or torque limiting system that can be structured and configured to measure (and/or limit) the torque transferred or imparted to a target device at first end 606 of shaft 604 via a bit socket (and bit), permanent drive implement, or other suitable arrangement. The torque transferred or imparted to the target device can be essentially the same as or identical to the torque imparted to shaft 604 from handle 608 and attachment feature 610 (subject, potentially, to the torque being limited by a torque limiting system, when included). Note that in use, torque can be transferred to shaft 604 essentially solely via manual manipulation of handle 608 (for example, when no secondary driver 612 or another device is coupled to attachment feature 610); essentially solely via attachment feature 610 (for example, when secondary driver 612 or another device is coupled to attachment feature 610, and substantially no torque is imparted to handle 608 by direct manual manipulation, as may occur when a user's hand contacts swivel feature 622 but not handle 608); or via both handle 608 and attachment feature 610.

The torque measurement and/or torque limiting system(s) can be structured and configured such that they properly account for torque imparted to shaft 604 from both handle 608 and attachment feature 610. In some configurations, attachment feature 610 can be directly mechanically attached or coupled to handle 608, and torque imparted via the attachment feature can be essentially passed-through the handle. In such configurations, torque can be measured and/or limited at a location between handle 608 and shaft 604. In some other configurations, attachment feature 610 can be directly mechanically attached or coupled to shaft 604. In such configurations, torque can be measured and/or limited at a location of shaft 604 between attachment feature 610 and first end 606. The torque measurement and/or torque limiting system(s) generally can include components housed out of view of a user and thus not shown in FIGS. 6 and 7 (e.g., within handle 608) and that generally are known in the arts of torque measurement and torque limitation. Torque measurements and/or limit settings can be provided to a user in any suitable manner, such as via a gauge 634 as illustrated, via audible feedback, via wireless communication to another device, and so on. In configurations with a torque limiting system, a torque value can be pre-selected and feedback provided to a user when the pre-selected torque value is met.

In some embodiments with a torque limiting system, a torque-value selection mechanism can be integrated or provided in combination with swivel feature 622. In some embodiments that do not include a swivel feature, a torque-value selection mechanism can include a torque-value selection knob at the end of handle 608, generally at the location of feature 622 in FIGS. 6 and 7. In some embodiments, a torque-value selection mechanism can be located away from swivel feature 622. In some embodiments, a torque-value selection mechanism can be structured and configured to enable an end user to pre-select a torque limit value. In some other embodiments, a torque-value selection mechanism can be structured and configured to enable setting of a torque value at the time of manufacture, but not to permit an end user to pre-select a torque limit value.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is intended also to include features of a claim in any other independent claim even if this claim is not directly made dependent to the independent claim.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of Section 112, sixth paragraph of 35 U.S.C. are not to be invoked unless the specific terms "means for" or "step for" are recited in a claim.

What is claimed is:

1. A screwdriver, comprising:

a shaft having a first end, a second end, and a primary axis, the shaft being structured and configured to transfer torque at the first end;

a handle coupled to the shaft at the second end of the shaft; and an attachment feature that is a direct extension of the shaft that extends from the shaft and into an opening in the handle such that torque applied to the attachment feature is transferred to the shaft, the attachment feature being structured, configured, and oriented such that a secondary screwdriver can reversibly couple to the attachment feature, whereby the secondary screwdriver, when so-coupled, has a primary axis that is oriented perpendicular to the primary axis of the shaft.

2. The screwdriver of claim 1, wherein the attachment feature is a hexagonal stud.

3. The screwdriver of claim 1, wherein the handle is structured and configured parallel to the shaft such that the handle is ergonomically graspable by a user's hand with the user's hand wrapped around the primary axis of the shaft.

4. The screwdriver of claim 1, further comprising a swivel feature coupled to the handle structured and configured to receive manual force applied along the primary axis of the shaft, whereby the swivel feature is further structured and configured to rotate about the primary axis of the shaft relative to the handle, thereby facilitating rotation of the shaft relative to the swivel feature as manual force is applied to the swivel feature as the swivel feature is held stationary.

5. The screwdriver of claim 4, wherein the swivel feature is located at an end of the handle opposite the first end of the shaft.

6. The screwdriver of claim 5, further comprising a selectively-removable endcap of the handle, wherein the swivel feature is rotatably attached to the selectively-removable endcap and is located at an outermost position on the screwdriver.

7. The screwdriver of claim 6, wherein the selectively-removable endcap of the handle provides access to, and security for, a storage compartment of the handle.

8. The screwdriver of claim 7, further comprising an illumination system integrated with the handle, and wherein the storage compartment houses an illumination system power supply.

9. The screwdriver of claim 8, wherein the selectively-removable endcap includes a switch for the illumination system.

10. The screwdriver of claim 4, wherein the swivel feature is structured and configured to receive manual force applied by a user's palm.

11. The screwdriver of claim 1, wherein the shaft includes, at the first end, at least one of a hexagonal bit socket, a flat-blade, or a Phillips-head.

12. The screwdriver of claim 1, further comprising a torque measuring mechanism structured and configured to provide a measurement of torque transferred at the first end.

13. The screwdriver of claim 1, further comprising a torque limiting mechanism structured and configured to limit torque transferred at the first end, wherein the torque limiting mechanism is structured and configured to enable selection of a pre-determined torque limit value.

14. The screwdriver of claim 1, wherein the attachment feature is located closer to the first end of the shaft than to the second end of the shaft.

15. A screwdriver system, comprising:

a primary driver, the primary driver including:

a shaft having a first end, a second end, and a primary axis, the shaft including at the first end a hexagonal bit socket;

a handle coupled to the shaft at the second end of the shaft, the handle being structured and configured parallel to the shaft such that the handle is ergonomically graspable by a user's hand with the user's hand wrapped around the primary axis of the shaft;

a hexagonal attachment feature configured to couple to another hexagonal bit socket, the hexagonal attachment feature being a direct extension of the shaft that extends from the shaft and into an opening in the handle such that torque applied to the hexagonal attachment feature is transferred to the shaft; and a secondary driver, the secondary driver including:

a secondary driver shaft having a first end, a second end, and a primary axis, the secondary driver shaft including at the first end a hexagonal bit socket; and a secondary driver handle coupled to the secondary driver shaft at the second end of the secondary driver shaft, the secondary driver handle being structured and configured parallel to the secondary driver shaft, wherein the hexagonal attachment feature of the primary driver is structured, configured, and oriented such that the secondary driver can reversibly couple to the hexagonal attachment feature via the hexagonal bit socket of the secondary driver shaft, whereby the secondary driver, when so-coupled, is oriented with the primary axis of the secondary driver shaft perpendicular to the primary axis of the shaft of the primary driver.

16. The system of claim 15, wherein the primary driver comprises a swivel feature coupled to the handle structured and configured to receive manual force applied along the primary axis of the shaft, whereby the swivel feature is further structured and configured to rotate about the primary axis of the shaft relative to the handle, thereby facilitating rotation of the shaft relative to the swivel feature as manual force is applied to the swivel feature as the swivel feature is held stationary.

17. The system of claim 15, wherein the primary driver further comprises at least one of a torque measuring mechanism and a torque limiting mechanism.

18. The system of claim 17, wherein the primary driver further comprises the torque measuring mechanism, the torque measuring mechanism being structured and configured to provide a measurement of torque transferred at the first end.

19. The system of claim 17, wherein the primary driver further comprises the torque limiting mechanism, the torque limiting mechanism being structured and configured to limit torque transferred at the first end.

* * * * *